US005392108A

United States Patent [19]

DeWaters et al.

[11] Patent Number: 5,392,108

[45] Date of Patent: Feb. 21, 1995

[54] STRIPPING DEVICE

[75] Inventors: Terry L. DeWaters; John H. Looney, both of Fairport, N.Y.

[73] Assignee: Xerox Corporation, Stamford, Conn.

[21] Appl. No.: 155,339

[22] Filed: Nov. 22, 1993

[51] Int. Cl.[6] ..... G03G 21/00

[52] U.S. Cl. ..... 355/315; 271/307

[58] Field of Search ..... 355/315; 271/307, 308, 271/311

[56] References Cited

U.S. PATENT DOCUMENTS

| | | | |
|---|---|---|---|
| 3,985,436 | 10/1976 | Tanaka et al. | 355/200 |
| 4,252,310 | 2/1981 | Kono et al. | 271/308 |
| 4,475,804 | 10/1984 | Kanno et al. | 271/311 X |
| 4,487,158 | 12/1984 | Kayson | 271/311 X |
| 4,748,473 | 5/1988 | Tsuraoka | 355/315 |
| 4,951,936 | 8/1990 | Taniyama | 271/307 |
| 5,053,830 | 10/1991 | Arai | 355/315 X |
| 5,098,627 | 3/1992 | Yoshikawa et al. | 271/308 X |
| 5,161,796 | 11/1992 | Okamoto | 271/308 |

*Primary Examiner*—Fred L. Braun

[57] ABSTRACT

A two member stripping device has a pivotable stripping finger and a mounting bracket for supporting the pivotable stripping finger in stripping engagement with a photoreceptor, the mounting bracket having two spaced parallel integrally molded support arms with male pivot bearing surfaces for pivotally supporting the stripping finger, the male bearing surfaces being oppositely faced toward each other on the interior of the arms; the stripping finger having integrally molded a stripping tip at one end, a pivoting ballast at the opposite end connected by a web member which has female pivot bearing surfaces between the finger and the ballast in the shape of cups on each side of the web for pivotal engagement with the male bearing surfaces, the extension of the female bearing surfaces extend axially beyond the operating bearing surfaces as a protective shield for the bearing surfaces.

19 Claims, 5 Drawing Sheets

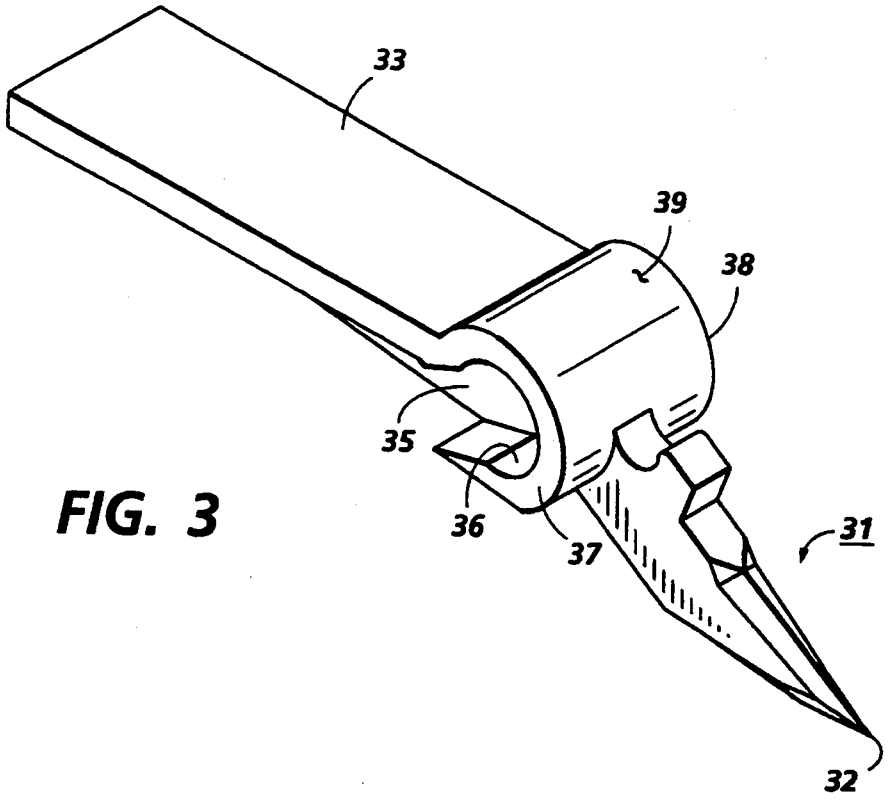
FIG. 3
FIG. 4
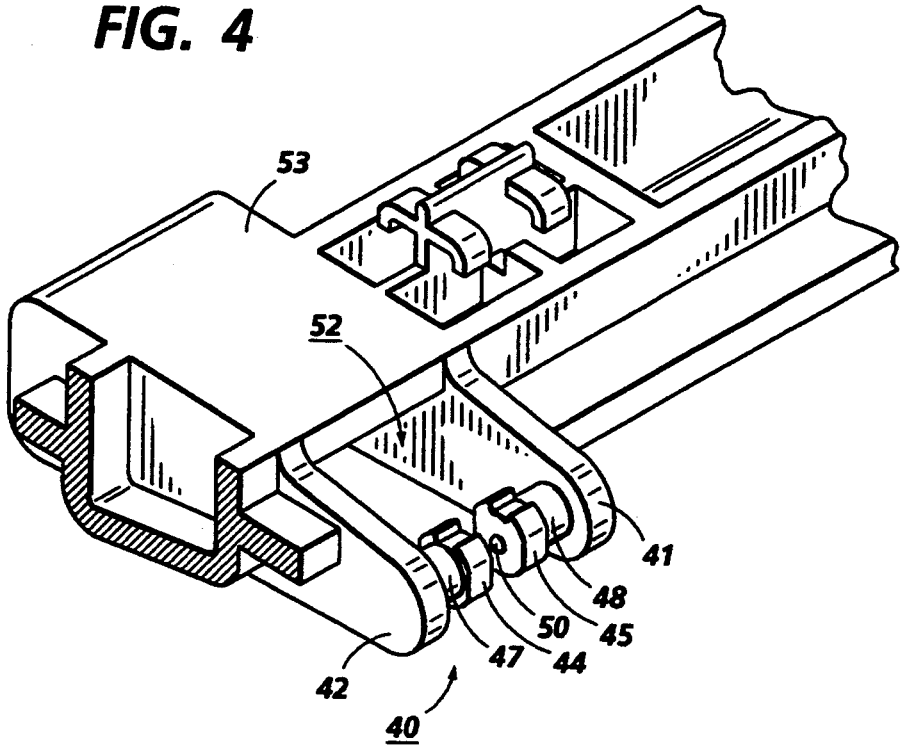

STRIPPING DEVICE

The present invention relates to a two-member stripping device for stripping substrate sheets such as paper from a photoreceptor. It further comprises a stripping assembly including a plurality of such two-member stripping devices as well as an electrostatographic printing apparatus wherein the stripping assembly is used to strip a tacked substrate from the surface of the photoreceptor.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles which may be from a single component developer or from a two component developer with larger carrier particles are attracted onto the latent image. The resultant toner powder image is then transferred from the photoconductive surface to a sheet of support material and permanently affixed thereto. This process is well known and useful for light lens copying from an original and in printing applications from electronically generated or stored originals.

Many commercial applications of the above process employ a modular concept for the various processing stations. For example, the imaging member, developer assembly and cleaner assembly may be combined in a single unit or cartridge which has a limited life at the end of which it may be discarded and replaced with a new unit or cartridge. Alternatively, a charging device may be added to the unit or the unit may contain either of the developer or the cleaner.

For example, U.S. Pat. No. 3,985,436 (Tanaka et al.) describes a copying apparatus in which an imaging member, developing device and cleaner may be incorporated in a casing as one unit to be releasably inserted into the main apparatus housing.

In many commercial applications it is desirable to provide assistance in physically separating the copy sheet bearing the toner image from the imaging member since the copy sheet may be tacked to the imaging member and which if not separated, may enter the cleaner housing resulting in a paper jam, loss of copy and contamination of the machine by toner displaced from the cleaner.

PRIOR ART

U.S. Pat. No. 4,748,473 to Tsuraoka describes a detack claw mounted on the bottom of the cleaner which is brought into contact with the imaging member to detack a copy sheet therefrom which includes a rotatably mountable shaft supporting the claw, a pair of shafts support members extending downward from the cleaning assembly, each having a recess in its lower corner adjacent the imaging member for supporting the shaft and at least one elastic support member extending downward from the cleaning assembly in cooperative association with the pair of shaft support members for pressing the shaft in the recess.

FIG. 2 illustrates an alternative detack or stripping mechanism from that described in U.S. Pat. No. 4,748,473 wherein the stripper finger is mounted on a shaft which is rotatable, the two ends of the shaft are each mounted to fixed under/over/under shaft retention clip members at each end as illustrated in FIGS. 2*a* and 2*b*. The stripper finger is inserted by placing the two ends of the shaft in the under/over/under clip assembly by pushing it in the direction of the arrow to facilitate a clip type fastening arrangement in the under-/over/under retention member as illustrated in FIG. 2*b*.

While capable of performing in certain applications this arrangement suffers deficiencies in that nontransferred toner, dust and debris fall onto the stripper finger mounting pivot contaminating the pivot so that the stripper finger cannot properly pivot and therefore the tip of the stripper finger does not touch the photoreceptor surface and the sheet is not stripped.

Since there is a very low force at the tip of the stripper finger to avoid damage to the photoreceptor even very small amounts of toner and dust in the pivoting area of the stripper finger could cause sufficient contamination to make the pivot sticky and unreliable. This is complicated by the fact that the mounting of the photoreceptor in each machine is not necessarily precisely the same for each mounting and therefore there is a need for the flexible pivotable stripper finger to be capable of uncontaminated individual adjustment.

SUMMARY OF THE INVENTION

In accordance with a principle aspect of the present invention a two-member stripping device comprising a pivotable stripping finger and a mounting bracket for supporting the pivotable stripping finger in stripping engagement with the photoreceptor is provided. The mounting bracket has two spaced parallel intregally molded support arms with male pivot bearing surfaces for pivotally supporting the stripping finger which are oppositely faced toward each other on the interior of the arms. The stripping finger has intregally molded a stripping tip at one end, a pivoting ballast at the opposite end connected by a web member which has a female pivot bearing surface between the finger and the ballast in the shape of cups on each side of said web for pivotal engagement with the male bearing surfaces, the exterior of said female bearing surfaces extending axially beyond the operating bearing surfaces as a protective shield for the bearing surfaces.

In a further aspect of the present invention the center of mass of the stripping finger is on the opposite side of the pivot from the finger tip to apply a force to rotate the stripping finger about the pivot.

In a further aspect of the present invention each of the cups forming the female pivot bearing surfaces is a portion of a circle greater than 180 degrees to facilitate insertion during assembly and retention in the mounting bracket after assembly.

In a further aspect of the present invention the stripping finger is made of a polyamideimide and the tip of the stripper finger has a radius less than 0.04 mm.

In a further aspect of the present invention the male pivot bearing surfaces comprise spacer members from each of the arms to bearing hubs which laterally position the stripper finger and pivotally engage the female bearing surfaces to form a pivotable stripping finger.

In a further aspect of the present invention each of the bearing hubs has a raised pivot point to provide low pivot contact area with the web of the stripper finger and to minimize axial movement of the stripper finger.

In a further aspect of the present invention a stripping assembly comprising a plurality of the two-member stripping devices is used in an electrostatic printing apparatus to strip print substrates from a photoreceptor.

In a further aspect of the present invention, the mounting brackets for each of said two-member stripping devices are part of an integrally molded member which includes means responsive to external drive means to laterally oscillate the stripping assembly across the surface of the photoreceptor.

A BRIEF DESCRIPTION OF THE DRAWINGS

FIG. 1 is a schematic representation in cross section of an electrostatographic printing apparatus according to the present invention employing a two-member stripping device as described herein.

FIGS. *2a* and *2b* are representative of prior art stripping devices.

FIG. 3 is an isometric view of the stripper finger illustrating the interior female bearing surface.

FIG. 4 is an isometric view of a mounting bracket for the stripping finger from the two-member stripping device according to the present invention. The bracket member is illustrated as part of an intregally molded member capable of supporting a plurality of two-member stripping devices in a stripping assembly.

DESCRIPTION OF PREFERRED EMBODIMENT

Figure 1:
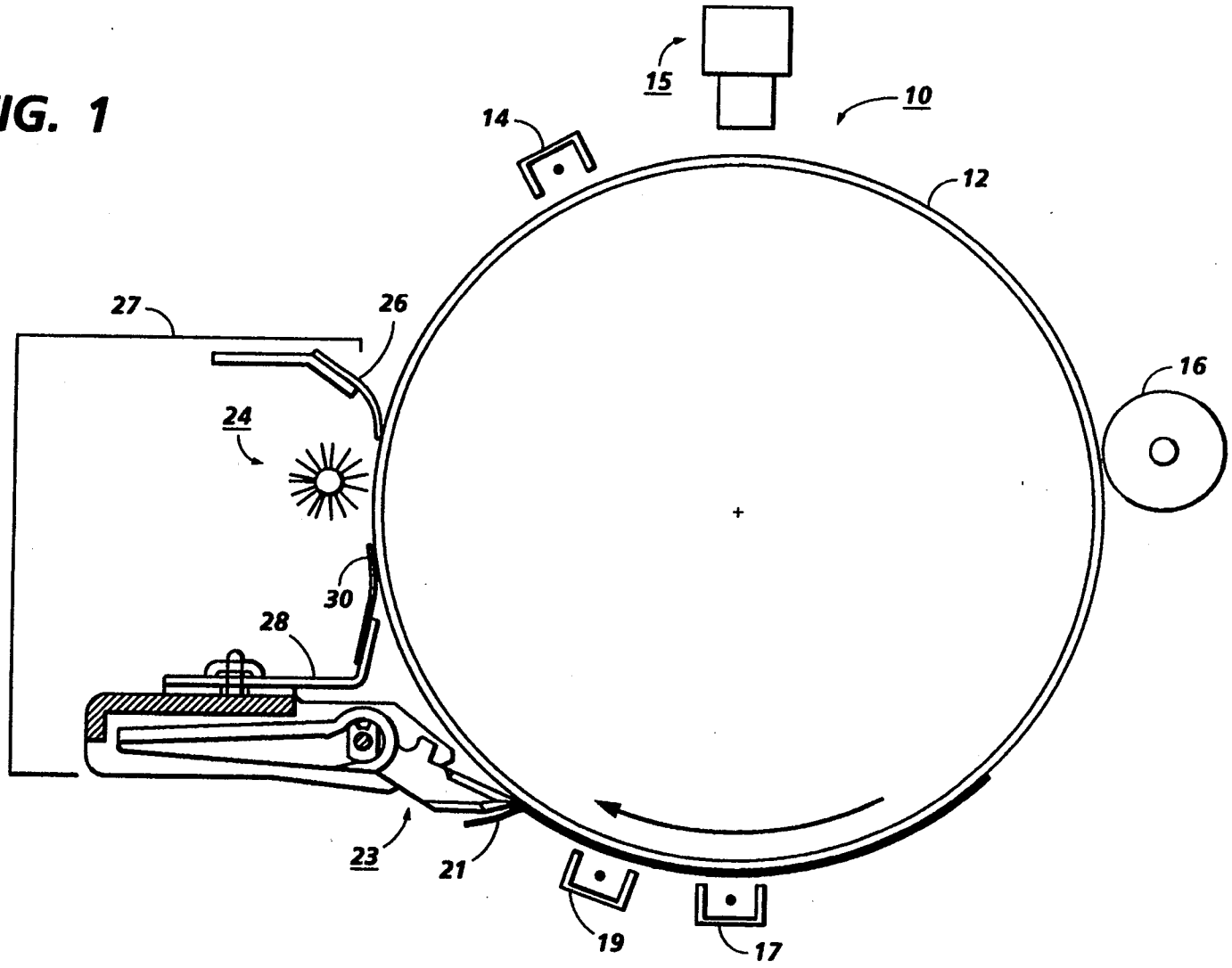
Figure 2A:
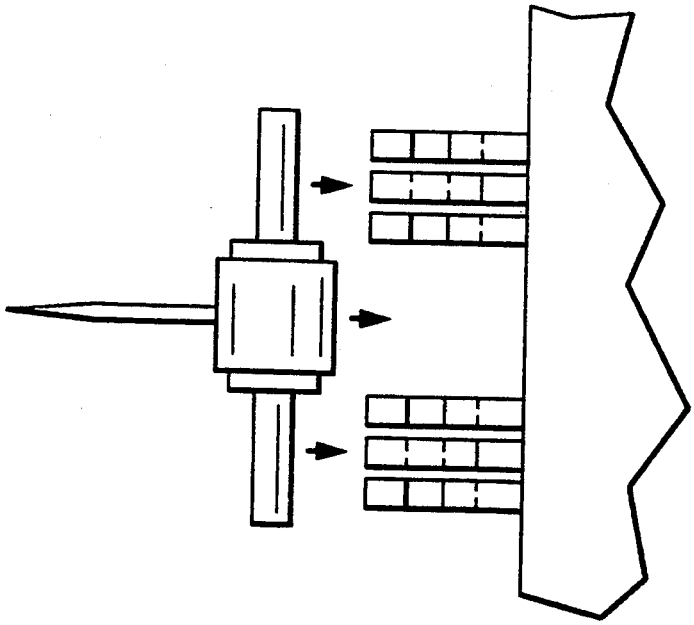
FIG. 2A PRIOR ART
Figure 2B:
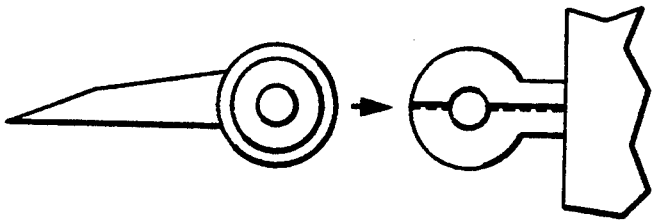
FIG. 2B PRIOR ART

The two-member stripping device according to the present invention and its application in stripping assemblies and electrostatographic printing apparatus will be described with reference to FIGS. 1, 3, 4, 5 and 6. Turning initially to FIG. 1 which is a schematic representation in cross section of the electrostatographic printing apparatus 10 in which the two-member stripping device may be employed a photoreceptor drum 12 is illustrated as being rotatable in the direction of an arrow. In forming an image on a print substrate such as paper the photoreceptor is first charged at charging station 14 exposed to an image pattern at exposure station 15 developed with toner at development station 16. The developed toner image is transferred to the print substrate at transfer station 17 after which the substrate is detacked from the photoreceptor by detack corotron 19 and the lead edge of the substrate 21 is stripped from the surface of the photoreceptor by the two-member stripping device 23. Thereafter, the photoreceptor continues to rotate past a disturber brush 24 which disturbs and loosens any toner remaining on the photoreceptor which is subsequently cleaned by cleaning blade 26 which permits the cleaned or waste toner to be stored in the cleaner housing 27. Mounted to the top of the stripping assembly is a toner seal assembly comprising a toner seal bracket 28 supporting a polyurethane film seal 30 to seal off a return path of any toner that may be cleaned from the surface of the photoreceptor to the stripping assembly and other parts of the machine.

The apparatus as illustrated in FIG. 1 may take many forms. One form in particular is that of having the photoreceptor, cleaning blade, cleaner housing, disturber brush and stripping device in the form of a removable process unit which may be inserted and withdrawn from the main body of the machine which would contain as permanent fixtures the developer apparatus, transfer and detack devices, charge exposure mechanisms as well as the transport for the substrate through a path in the machine to provide a fused toner image on a final print.

Figure 5:
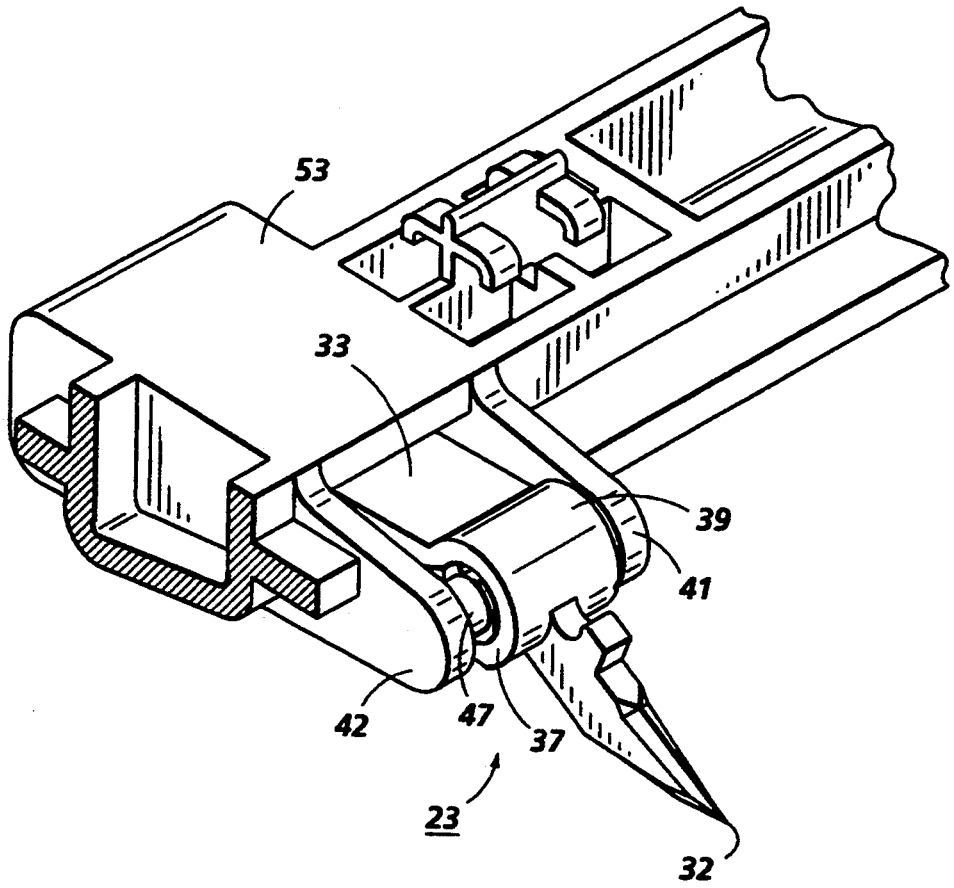
FIG. 5 is an isometric view of an assembled two-member stripping device according to the present invention.

Turning now to FIGS. 3, 4 and 5, the two-member stripping device will be described in greater detail. The pivotable stripper finger 31 which is positioned by its mounting bracket in stripping engagement with a photoreceptor comprises an intregally molded member having a stripping tip 32 at one end, a pivoting ballast 33 at the opposite end which is connected by a thin web member 35 which has a female pivot bearing surface 36 between the fingertip 32 and the ballast 33 in the shape of cups 37, 38 on each side of the web 35 for pivotal engagement with a male bearing surface hereinafter to be described. The female bearing surface 36 is on the interior of the cups 37, 38 which extend axially beyond the operating bearing surfaces and the exterior surface of the cups acts as a protective shield 39 for the male and female bearing surfaces. Each of the cups is a portion of a circle greater than 180 degrees. This facilitates insertion of the stripper finger during assembly as well as retention of the stripper finger in the mounting bracket after assembly. The center of mass of the stripper finger is on the opposite side of the pivot from the fingertip to apply a force to rotate the stripper finger about the male bearing surface. The stripper finger or at the very least the tip of the stripper finger is made from a very hard structural plastic such as Torlon which is a polyamideimide available from Amoco, of Atlanta, Ga. A very hard plastic material is required in this application since the specific geometry of the tip experiences very high tip stress. Since the toner is very loosely held on the photoreceptor the tip must be narrow to avoid accumulation of toner so it will not offset on the edge of a copy sheet. In addition, the tip radius must be smaller (thinner) than the paper to effectively strip the paper. As a result of this stripper finger geometry, it effectively strips substrate sheets such as paper, as well as protecting the pivoting joint from toner and other debris as a result of the female cups extending axially beyond the bearing operating surfaces and therefore acts as a protective shield for the bearing surfaces.

A mounting bracket 40 illustrated in FIG. 4 is also an integrally molded one-piece member and comprises two-spaced parallel integrally molded support arms 41, 42 with male pivot bearing surfaces for pivotally supporting the stripping finger. The male pivot bearing surface surfaces are oppositely faced toward each other on the interior of the arms and include spacer members 47, 48 between the arms and the bearing hubs 44, 45 which laterally position the stripper finger and pivotally engage the female bearing surfaces 36 to form a pivotable stripping finger. Each of the bearing hubs 44, 45 has a raised pivot point 50 to provide low pivot contact area with the web of the stripping finger and to minimize axial movement of the stripper finger. Since the interior of the mounting bracket is essentially hollow having only the two arms and the top, the two member stripping device is readily assembled by inserting the ballast end of the stripping finger into the aperture 52 between the two arms and top 53 of the mounting bracket as illustrated in FIG. 5. Upon insertion the female bearing surfaces will contact and pivot about the male bearing surfaces. However, since the center mass of the stripper finger is in the ballast portion when held in the horizontal position, the stripping device will have the stripping tip pointing upward and the ballast pointing downward and the tip finger being pivotable about the bearing surfaces. When viewed in operational position as in FIG. 1, the surface of the photoreceptor locates the position of the tip 32 of this stripping finger by virtue of it's mere proximity to the finger.

Figure 6:
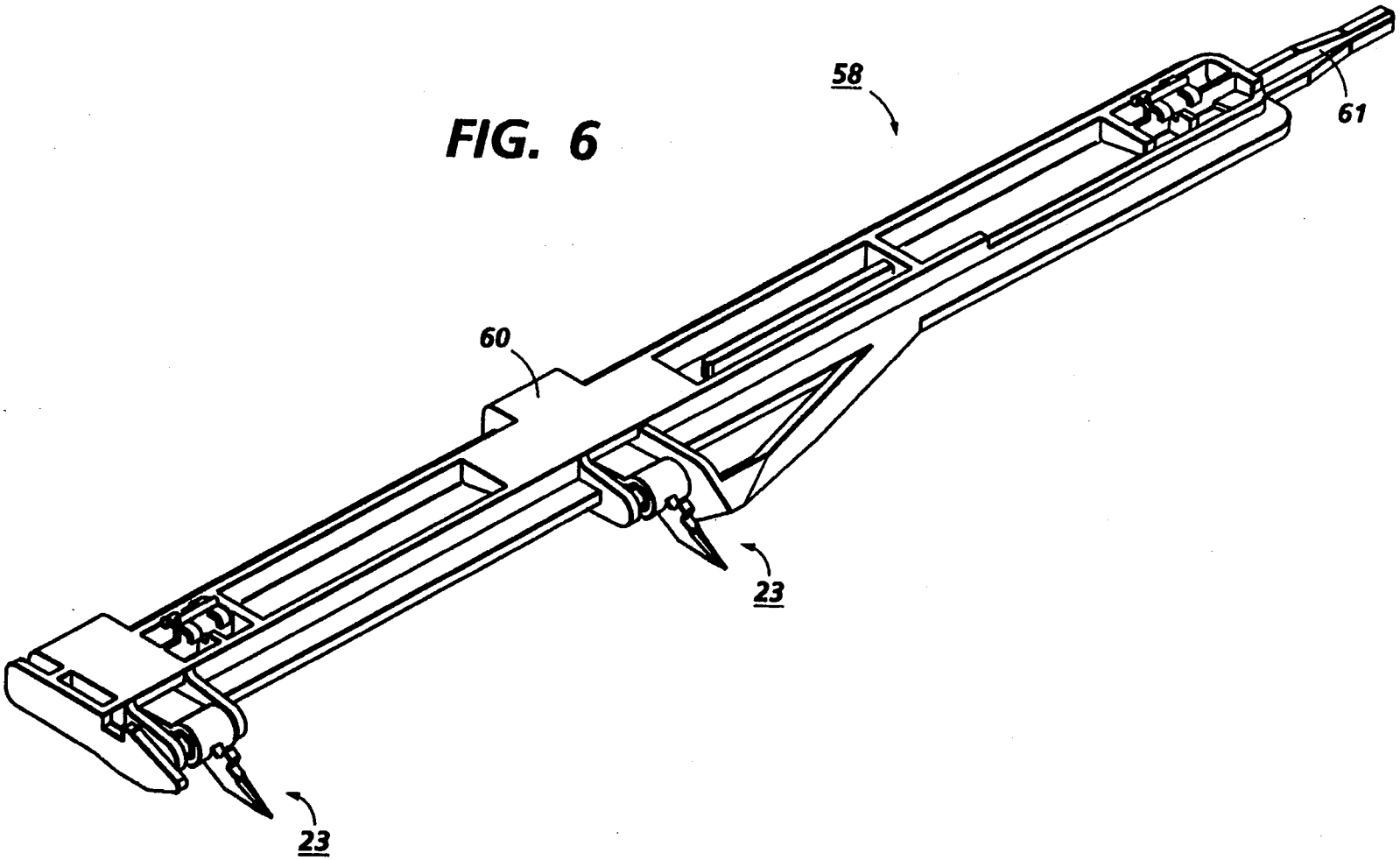
FIG. 6 is an isometric view illustrating two two-member stripping devices according to the present invention as well as a molded in push rod to enable the stripping assembly to be moved laterally with respect to the photoreceptor.

While in some applications it may be necessary to employ only one two-member stripping device to perform adequate stripping of the substrate from the photoreceptor, FIG. 6 illustrates an embodiment wherein stripping assembly 58 has a plurality of two-member stripping devices may be used. In this embodiment each of the mounting brackets supporting the pivotable stripping finger is part of an integrally molded member 60 which at it's one end has a push in rod 61 which is engaged by a wobble plate cam (not shown) to laterally oscillate the stripping assembly across the surface of the photoreceptor to periodically change the location of the stripping tips with respect to the photoreceptor surface thereby minimizing potential damage to the photoreceptor. Since the stripping assembly 58 and photoreceptor may be part of a removable process unit or cartridge in the machine the actuating means such as the wobble plate cam may be part of the main body of the machine and engages the push rod upon insertion of the removable process unit.

Thus according to the present invention a simple two-member stripping device has been provided. In addition, it is a device which may be used in the form of a stripping assembly which is useful in stripping substrate sheets such as print paper from a photoreceptor while providing a protective shield for the pivoting surfaces. It is very low in cost, easy to assemble, functions well in that it provides it's intended stripping and has a long stripping life.

The patents referred to herein are hereby specifically, totally and completely incorporated herein by reference.

While the present invention has been described with reference to specific embodiments described herein it will be apparent that many alternatives, modifications and variations may be made by those skilled in the art. For example, while the present invention has been described with reference to a cartridge type electrostatographic printing machine it will be understood that it can be used with any other machines wherein substrates such as paper have to be stripped from surfaces. Accordingly, it is intended to embrace all such alternatives and modifications as may fall within the spirit and scope of the appended claims.

We claim:

1. A two member stripping device comprising a pivotable stripping finger and a mounting bracket for supporting said pivotable stripping finger in stripping engagement with a photoreceptor, said mounting bracket having two spaced parallel integrally molded support arms with male pivot bearing surfaces for pivotally supporting said stripping finger, said male bearing surfaces being oppositely faced toward each other on the interior of said arms; said stripping finger having integrally molded a stripping tip at one end, a pivoting ballast at the opposite end connected by a web member which has female pivot bearing surfaces between said finger and said ballast in the shape of cups on each side of said web for pivotal engagement with said male bearing surfaces, the exterior of said female bearing surfaces extend axially beyond the operating bearing surfaces as a protective shield for said bearing surfaces.

2. The device of claim 1 wherein the center of mass of said stripper finger is on the opposite side of said pivot from said finger tip to apply a force to rotate said stripper finger about said pivot.

3. The device of claim 1 wherein each of said cups is a portion of a circle greater than 180° to facilitate insertion during assembly and retention in said mounting bracket after assembly.

4. The device of claim 1 wherein said stripper finger is made of a polyamideimide.

5. The device of claim 1 wherein said tip of said stripper finger has a radius less than 0.04 mm.

6. The device of claim 1 wherein said male pivot bearing surfaces comprise spacer members from each of said arms to bearing hubs which laterally position said stripper finger and pivotally engage said female bearing surfaces to form a pivotable stripping finger.

7. The device of claim 6 wherein each of said bearing hubs has a raised pivot point to provide low pivot contact area with the web of said stripper finger and to minimize axial movement of said stripper finger.

8. A stripping assembly for use in an electrostatographic machine for stripping a print substrate from a photoreceptor, said assembly comprising a plurality of two member stripping devices each comprising a pivotable stripping finger and a mounting bracket for supporting said pivotable stripping finger in stripping engagement with a photoreceptor, said mounting bracket having two spaced parallel integrally molded support arms with male pivot bearing surfaces for pivotally supporting said stripping finger, said male bearing surfaces being oppositely faced toward each other on the interior of said arms; said stripping finger having integrally molded a stripping tip at one end, a pivoting ballast at the opposite end connected by a web member which has female pivot bearing surfaces between said finger and said ballast: in the shape of cups on each side of said web for pivotal engagement with said male bearing surfaces, the exterior of said female bearing surfaces extend axially beyond the operating bearing surfaces as a protective shield for said bearing surfaces.

9. The stripping assembly of claim 8 wherein the center of mass of said stripper finger is on the opposite side of said pivot from said finger tip to apply a force to rotate said stripper finger about said pivot.

10. The stripping assembly of claim 8 wherein each of said cups is a portion of a circle greater than 180° to facilitate insertion during assembly and retention in said mounting bracket after assembly.

11. The stripping assembly of claim 8 wherein said stripper finger is made of a polyamideimide.

12. The stripping assembly of claim 8 wherein said tip of said stripper finger has a radius less than 0.04 mm.

13. The stripping assembly of claim 8 wherein said male pivot bearing surfaces comprise spacer members from each of said arms to bearing hubs which laterally position said stripper finger and pivotally engage said female bearing surfaces to form a pivotable stripping finger.

14. The stripping assembly of claim 13 wherein each of said bearing hubs has a raised pivot point to provide low pivot contact area with the web of said stripper finger and to minimize axial movement of said stripper finger.

15. The stripping assembly of claim 8 wherein each of said mounting brackets for supporting said pivotable stripping finger is part of an integrally molded member.

16. The stripping assembly of claim 15 including integrally molded means responsive to external drive means to laterally oscillate said stripping assembly across the surface of a photoreceptor to periodically change the location of the stripping tips with respect to a photoreceptor surface thereby minimizing potential damage to a photoreceptor.

17. An electrostatographic printing apparatus including means to form an electrostatic latent image on a photoreceptor, means to develop said image with toner marking material, means to transfer said toner image to a print substrate and means to strip said substrate from said photoreceptor, said means to strip comprising at least one two member stripping device comprising a pivotable stripping finger and a mounting bracket for supporting said pivotable stripping finger in stripping engagement with said photoreceptor, said mounting bracket having two spaced parallel integrally molded support arms with male pivot bearing surfaces for pivotally supporting said stripping finger, said male bearing surfaces being oppositely faced toward each other on the interior of said arms; said stripping finger having integrally molded a stripping tip at one end, a pivoting ballast at the opposite end connected by a web member which has female pivot bearing surfaces between said finger and said ballast in the shape of cups on each side of said web for pivotal engagement with said male bearing surfaces, the exterior of said female bearing surfaces extend axially beyond the operating bearing surfaces as a protective shield for said bearing surfaces.

18. The apparatus of claim 17 wherein said means to strip comprises a stripping assembly, said assembly comprising a plurality of two member stripping devices.

19. The apparatus of claim 18 including integrally molded means in said stripping assembly responsive to drive means to laterally oscillate said stripping assembly across the surface of a photoreceptor to periodically change the location of the stripping tips with respect to a photoreceptor surface thereby minimizing potential damage to a photoreceptor said apparatus including means to engage said responsive drive means to laterally oscillate said stripping assembly.

* * * * *